United States Patent [19]

Helg

[11] Patent Number: 4,526,222

[45] Date of Patent: Jul. 2, 1985

[54] LOW PRESSURE CASTING METHOD AND APPARATUS

[75] Inventor: Hansrudolf Helg, Schaffhausen, Switzerland

[73] Assignee: Georg Fischer Aktiengesellschaft, Switzerland

[21] Appl. No.: 491,999

[22] Filed: May 5, 1983

[30] Foreign Application Priority Data

May 14, 1982 [CH] Switzerland ..... 3007/82

[51] Int. Cl.[3] ..... B22D 17/06; B22D 17/30

[52] U.S. Cl. ..... 164/340; 164/339; 164/306; 164/119

[58] Field of Search ..... 164/119, 133, 137, 306, 164/307, 308, 339, 340

[56] References Cited

U.S. PATENT DOCUMENTS 3,656,539 4/1972 Zickefoose ..... 164/119 X 4,008,749 2/1977 Bellocci et al. ..... 164/119 X

*Primary Examiner*—Nicholas P. Godici

*Assistant Examiner*—Kenneth F. Berg

*Attorney, Agent, or Firm*—Roylance, Abrams, Berdo & Goodman

[57] ABSTRACT

A low pressure mold system includes a pouring-in core with a bore which is inserted into the upper part of a foundry mold. The bore is connected by an overflow channel and a drop channel with the hollow space of the mold which is to be filled. Melt is forced from below into the pouring-in channel of the casting mold. The core forms a channel in the shape of a siphon, permitting emptying of the pouring-in channel immediately after the filling process.

16 Claims, 4 Drawing Figures

Fig. 3
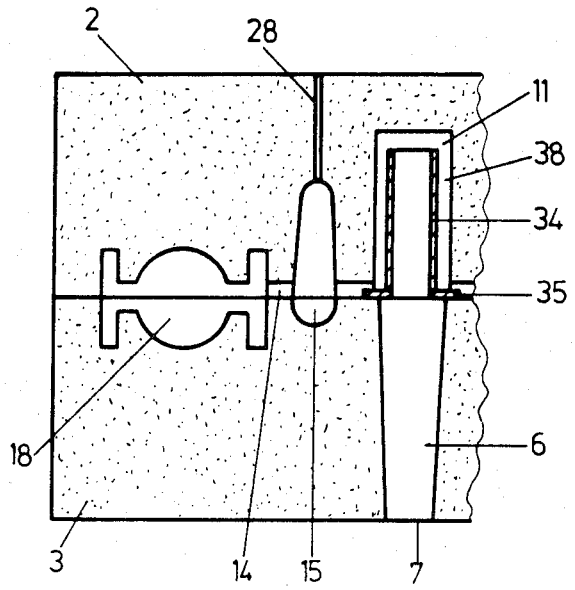
Fig. 2
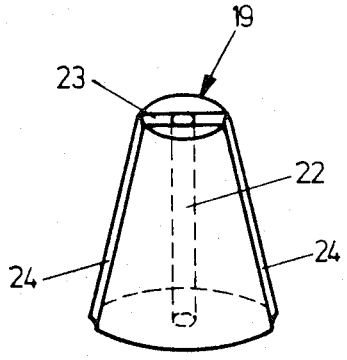
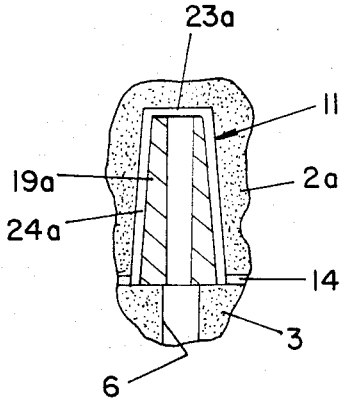
Fig. 1A

LOW PRESSURE CASTING METHOD AND APPARATUS

This invention relates to a low pressure casting method and apparatus in which molten casting material is injected upwardly from a melt to the foundry mold.

BACKGROUND OF THE INVENTION

As compared with the traditional gravitational casting systems, bottom casting in accordance with low pressure casting processes offers considerable advantages. For one, the metal melt does not come into contact with the oxygen of the air on its way from the pressure furnace receptacle up to the foundry mold. The rising pipe of the pressure furnace, which fits against the pouring gate opening below or on the lower part of the foundry mold, terminates close to the bottom where, in most cases the inductor is disposed so that, advantageously, the extraction of the melt takes place at the hottest location. Furthermore, no impurities can be carried forward from the top of the bath into the foundry mold. In low pressure casting, there exist no problems with variable heights of fall and deflectors of the jet, which are present in gravitational casting, for these can be omitted. It is advantageous, above all, that considerable reduction of the lost circulating material is possible primarily because the material in the vertically extending pouring gate empties back into the pressure furnace at the conclusion of the casting process.

German AS 25 58 449 (corresponding to U.S. Pat. No. 4,008,749) shows a low pressure casting process for the filling of vertically divided foundry molds. In foundry molds with a vertical separating plane, it is possible to mold in casting bays or runners extending slantingly downwardly which can also serve as feeders. Such slanting casting bays are not possible when using horizontally divided foundry molds, which are by far used most often. According to the above-mentioned German AS, several casting bays with small cross sections connect the pouring channel with the hollow spaces of the mold. The pressure on the bath level in the pressure furnace must be maintained after the filling process until the casting runners freeze up, i.e., until the melt in the casting runs solidifies. Only then is the melt in the pouring channel permitted to drop back into the pressure furnace. As a result, extended waiting times are necessary, leading to a reduced degree of effectiveness and reduced production rate. Moreover, there is the danger, which cannot be disregarded, that pressure breaks might develop so that the melt will run out.

BRIEF SUMMARY OF THE INVENTION

Accordingly, it is an object of the present invention to provide a low pressure casting method which does not exhibit the foregoing disadvantages and which permits a quick, simple, secure and economic operation without losing the inherent advantages of low pressure casting.

Briefly described, the invention includes a low-pressure casting method of the type in which a metal melt is forced upwardly through a riser pipe into a horizontally divided foundry mold comprising the steps of providing a foundry mold having at least one hollow space into which melt is to be conducted to form a casting, conducting the melt into an upwardly extending passage and over an overflow barrier in the foundry mold and thereafter into the hollow space, the upper limit of the overflow being at a height between the upper limit of the hollow space and the upper surface of the foundry mold.

In another aspect, the invention includes a foundry mold for use in a low pressure casting process, the mold being of the type having at least one hollow space in which a casting is to be formed, comprising upper and lower mold parts separated along a generally horizontal plane; means in said lower mold part defining inlet passage for melt up to said plane; means defining a recess extending upwardly into said upper mold part from said plane above said inlet passage; means defining a second melt-conducting passage from the lower part of said recess along said separating plane to said hollow space; and a core in said recess, said core and the walls of said recess forming a siphon-shaped channel for melt with an overflow location between said inlet passage and said second melt-conducting passage, said overflow location being positioned at a height above the highest point of said hollow space and below the top surface of the mold in its melt-receiving position.

As will be seen from the above, the method of operation is quick since there is no need to wait for solidification. It is simple because one may do without a slide on the pouring-in system, without a tipping mechanism for a ladle, and without a stopper closure in the ladle. It is furthermore safe, since the danger of pressure fracture is eliminated and it is economical since the circulating material can be reduced.

BRIEF DESCRIPTION OF THE DRAWINGS

In order the manner in which the foregoing and other objects are attained in accordance with the invention can be understood in detail, particularly advantageous embodiments thereof will be described with reference to the accompanying drawings, which form a part of this specification and wherein:

FIG. 1A is a partial, schematic side elevational view in section of a foundry mold according to another embodiment of the present invention;

FIG. 2 is a perspective view of a core usable as an insert in a foundry mold of the type shown in FIG. 1; and FIG. 3 is a partial side elevation, in section, of a further embodiment of a foundry mold in accordance with the invention;

DETAILED DESCRIPTION OF PREFERRED EMBODIMENTS

Figure 1:
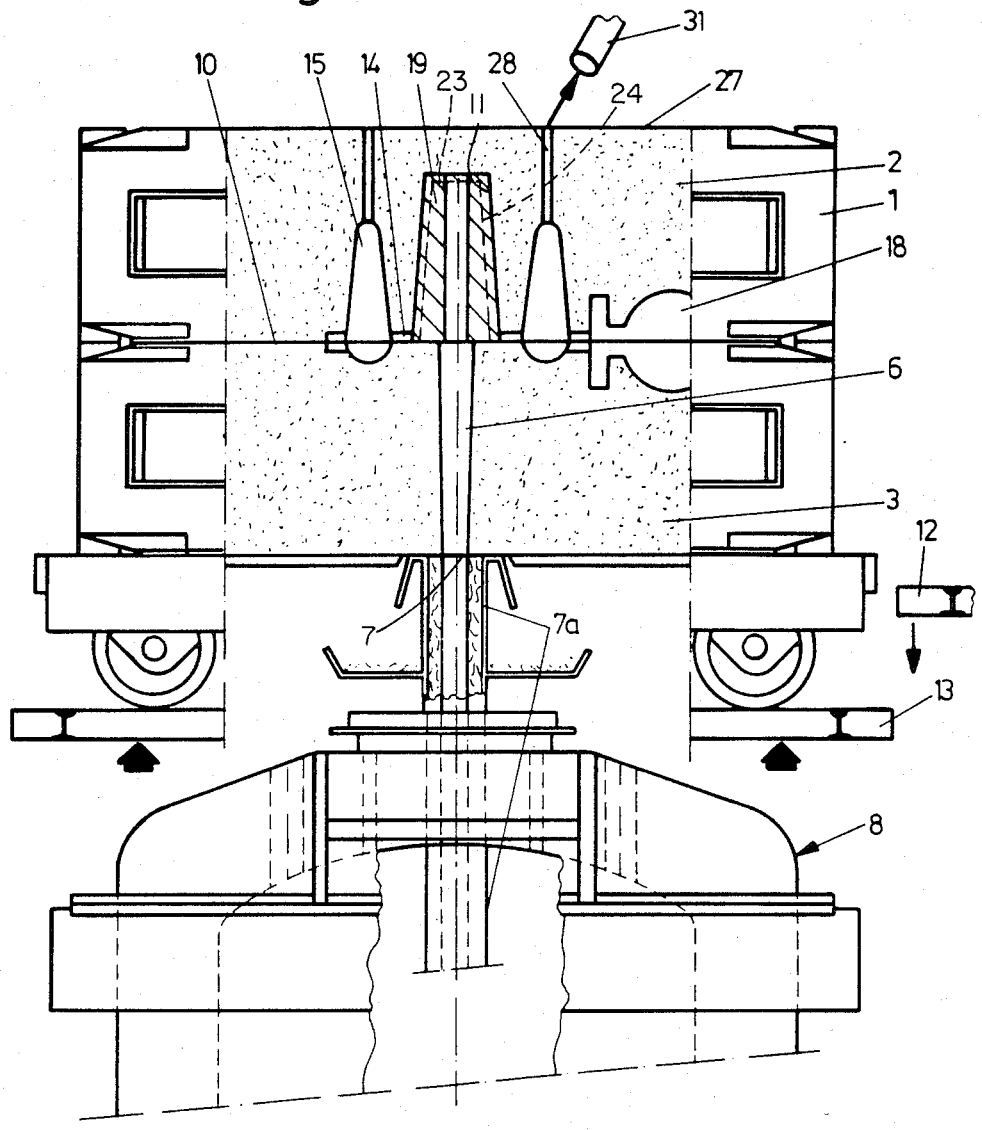
FIG. 1 is a schematic side elevation, in partial section, of a foundry mold in accordance with the invention in a low pressure casting arrangement.

FIG. 1 shows a horizontally separated sand foundry mold with an upper mold part 2 and a lower mold part 3, both of which are contained in a mold box 1, the arrangement being suitable for receiving iron melt. The lower part 3 of the foundry mold, in this example, is centrally penetrated by a pouring-in channel 6. The pouring gate opening 7 of which, during the filling process, fits against an upwardly extending pipe *7a* of a low pressure casting vessel indicated generally at 8. The path by which the foundry mold and its transport arrangement are brought to the pouring location including a conveyance path 12 and a weighing arrangement 13 have been indicated schematically. In the upper portion 2 of the foundry mold coaxial with respect to the pouring-in channel 6, there is a blind recess 11 which extends upwardly from the horizontal separating plane and which is connected, by way of casting runs 14 and feeder 15 lying in the separating plane 10 (i.e., bisecting or touching the separating plane) with two hollow spaces 18 of the mold. Spaces 18 are those which are to receive the melt and in which the ultimate castings will be formed. Projecting into this recess 11 is a pouring-in core 19, separately shown in FIG. 2, which fits flush against the wall of the recess. The core 19, because of the need to insert it into the recess, is advantageously in the shape of a truncated cone having a central, vertically aligned through-bore 22. The core 19 is supported by the upper surface of the lower part 3 of the foundry mold so that its position is fixed. In the border area of the core 19 and of the upper part 2 of the foundry mold, there is an overflow channel 23 for conducting melt to the molding hollow space 18, the channel 23 being regarded also as a gate, and a drop-channel 24. In the example shown, the channels 23, 24 are recessed in the outside wall of the core. It is, however, quite possible to form an overflow channel 23*a* and a drop channel 24*a* in the walls of upper portion 2*a* defining recess 11*a*, with frustoconical core 19*a* tightly engaging the recess walls between the channels, as illustrated in FIG. 1A.

The method of operation with this apparatus is as follows. Melt is forced upwardly, by action of pressure exerted against the top surface of the bath, into the low pressure pouring vent by way of the rising pipe into the pouring-in channel and into bore 22. The melt then flows into the overflow channel 23 and through the two drop channels 24 and then through casting run 14 into the hollow space 18 of the mold and into the feeder 15 such that the core 19 together with recess 11 forms a siphon-shaped channel 6, 22, 23, 24, 14 through which the melt reaches feeder 15 or the hollow space. A deaeration channel 28 runs from feeder 15 vertically upwardly to the upper reverse side (that side which is uppermost during casting) 27 of the mold. The pressure action lasts until an optical level indicator 31 reports that the feeder 15 and the deaeration channel 28 are filled. The metal level drops as a result of the absence of pressure acting in the bore 22 and in the pouring-in channel 6 so that those bores will be emptied. In order to ensure that the feeder 15 and the hollow space 18 of the mold have been filled completely with melt, the overflow 23 must lie at a height between the highest portion of the hollow space of the mold or of the feeder and the upper surface 27 of the mold. After the dropping back of the melt from bore 22 and from pouring-in channel 26 into the vessel, the drop-channels 24 remain filled.

FIG. 3 shows a further embodiment in accordance with the invention wherein the core has the shape of a cylindrical pipe 34 which made of core sand or of ceramic. The pipe 34 has a flange 35 which fits into a precisely into a recess and is immovably fixed by the lower part 3 of the foundry mold. The pipe 34, except from the flange part, does not touch the mold anywhere so that the danger of any damage to the mold during insertion of the core is decreased. The overflow barrier is formed by the upper end of the pipe. After the diminishing of the pressure action, melt remains in the annular hollow space 38 between pipe 34 and wall 11. This hollow space 38 may be dimensioned such that a separate feeder becomes superfluous, for example, by selecting the cross section of the pipe 34 round and the cross section of the recess 11 elliptical.

The drop level or head corresponds to the height of the core 19, 34 and may be selected corresponding to the development of the hollow space of the mold or of the feeder. Compared with gravitational casting, the drop level is considerably lower.

The molds shown may be foundry molds without boxes or foundry molds with molding frames. Not only sand molds but also metal molds can be filled in accordance with the invention. Other developments of molds, too, are possible. Thus, the core can have the shape of a plate which is inserted perpendicularly into recess 11 in such a way that two vertically aligned channels are formed wherein the highest part of the plate, i.e., its front side, again has an overflow and wherein the one channel is connected with the pouring-in channel and the other channel with the casting run 14.

While certain advantageous embodiments have been chosen to illustrate the invention, it will be understood by those skilled in the art that various changes and modifications can be made therein without departing from the scope of the invention as defined in the appended claims.

What is claimed is:

1. A foundry mold for low pressure casting wherein metal melt is forced upwardly through a riser pipe into the mold, comprising:

upper and lower mold parts horizontally divided by a horizontally extending separating plane, said upper mold part having an upper surface, said lower mold part having a top surface a pouring gate opening in a lower surface thereof and a pouring-in channel extending upwardly from said gate opening;

a hollow mold space and a casting run defined in said mold parts;

a blind recess in said upper mold part extending upwardly from said separating plane, said casting run connecting said blind recess to said mold space;

a core contained within said blind recess and supported on said top surface of said lower mold part, said core having an overflow channel at a top end thereof between said upper surface and a highest point of said mold space or said casting run such that said core, said recess and said casting run form a siphon-like passage for melt conveyed through said gate opening and said pouring-in channel.

2. A foundry mold according to claim 1 wherein said core comprises a vertically extending through bore in fluid communication with said gate opening.

3. A foundry mold according to claim 2 wherein said core tightly engages walls defining said recess and comprises at least one drop channel formed at an interface of an outer side surface of said core and said recess walls, said overflow channel being formed at an interface of a top surface of said core and said recess walls.

4. A foundry mold according to claim 1 wherein said core tightly engages walls defining said recess and comprises at least one drop channel formed at an interface of an outer side surface of said core and said recess walls, said overflow channel being formed at an interface of a top surface of said core and said recess walls.

5. A foundry mold according to claim 4 wherein said core is frustoconical.

6. A foundry mold according to claim 3 wherein said core is frustoconical.

7. A foundry mold according to claim 2 wherein said core is frustoconical.

8. A foundry mold according to claim 1 wherein said core is frustoconical.

9. A foundry mold according to claim 5 wherein said overflow channel and said drop channel are recessed within said surfaces of said core.

10. A foundry mold according to claim 4 wherein said overflow channel and said drop channel are recessed within said surfaces of said core.

11. A foundry mold according to claim 3 wherein said overflow channel and said drop channel are recessed within said surfaces of said core.

12. A foundry mold according to claim 5 wherein said overflow channel and said drop channel are recessed within said recess walls.

13. A foundry mold according to claim 4 wherein said overflow channel and said drop channel are recessed within said recess walls.

14. A foundry mold according to claim 3 wherein said overflow channel and said drop channel are recessed within said recess walls.

15. A foundry mold according to claim 2 wherein said core comprises a cylindrical pipe laterally spaced from walls defining said recess to form an annular hollow space therebetween.

16. A foundry mold according to claim 1 wherein said core comprises a cylindrical pipe laterally spaced from walls defining said recess to form an annular hollow space therebetween.

* * * * *